United States Patent [19]

Hall et al.

[11] Patent Number: 4,922,259

[45] Date of Patent: May 1, 1990

[54] MICROSTRIP PATCH ANTENNA WITH OMNI-DIRECTIONAL RADIATION PATTERN

[75] Inventors: Edward A. Hall, Florissant; Thomas H. B. Cranor, Richmond Heights; Gilbert J. Schmitt, St, Louis, all of Mo.

[73] Assignee: McDonnell Douglas Corporation, St. Louis, Mo.

[21] Appl. No.: 152,245

[22] Filed: Feb. 4, 1988

[51] Int. Cl.[5] ..... H01Q 1/38; H01Q 21/24

[52] U.S. Cl. ..... 343/700 MS; 343/705; 343/829; 343/853

[58] Field of Search ..... 343/700 MS, 705, 708, 343/829, 846, 853, 830

[56] References Cited

U.S. PATENT DOCUMENTS

| | | | |
|---|---|---|---|
| 3,478,362 | 11/1969 | Ricardi et al. | 343/700 MS |
| 4,527,163 | 7/1985 | Stanton | 343/700 MS |
| 4,709,239 | 11/1987 | Herrick | 343/700 MS |

FOREIGN PATENT DOCUMENTS

| | | | |
|---|---|---|---|
| 0059607 | 4/1983 | Japan | 343/700 MS |
| 0236302 | 11/1985 | Japan | 343/713 |
| 0236303 | 11/1985 | Japan | 343/700 MS |

OTHER PUBLICATIONS

Jasik, H., et al, Antenna Engineering Handbook 2nd Ed., New York, 1984.

*Primary Examiner*—Rolf Hille
*Assistant Examiner*—Doris J. Johnson
*Attorney, Agent, or Firm*—Benjamin Hudson, Jr.; George W. Finch; John P. Scholl

[57] ABSTRACT

A microstrap patch antenna with a substantially omni-directional radiation pattern includes an upper hemisphere microstrip patch radiator working against a ground plane and a lower hemisphere microstrip patch radiator working against a ground plane, the ground planes being oriented in close proximity and spaced apart from each other. One of the radiators is excited in left hand circular polarization and the other in right hand circular polarization such that their fields add constructively across their ground planes to achieve an omni-directional radiation pattern.

13 Claims, 2 Drawing Sheets

MICROSTRIP PATCH ANTENNA WITH OMNI-DIRECTIONAL RADIATION PATTERN

BACKGROUND AND SUMMARY OF THE INVENTION

Receiving a linearly polarized microwave signal from a ground station by a moving vehicle is a problem which has existed for some time. A typical solution to this problem is to mount an antenna known to provide omni-directional radiation on the vehicle, such as a crossed dipole, or the like. However, for certain kinds of vehicles, such as aircraft, the construction and mounting of such a typical omni-directional antenna can be cumbersome, inconvenient, or even not feasible due to the excessive speeds and limited mounting space available within the aircraft. Of course, the reason for using an omni-directional antenna is to ensure reception of the linearly polarized signal from a ground station or the like as the orientation of the aircraft changes with respect to the ground station.

To solve these and other problems in the prior art, the inventors herein have succeeded in developing a substantially omni-directional radiating antenna suitable for reception of a linearly polarized signal from a ground station but which uses microstrip patch radiators for the active elements. As is known in the art, microstrip patch radiators are relatively easy to build, such as by chemical etching of conductors on copper clad circuit board modules comprised of one or more layers, and are thin, flat, and conformable. These radiators are particularly well suited for use in an aircraft as they may be readily shaped to fit the curvature of the outer surface. In the first embodiment of the present invention, a pair of microstrip patch radiators are mounted back-to-back, each radiator being mounted on a metal plate which serves both as its mounting shelf and ground plane, the ground planes being mounted in close proximity but spaced apart from each other such that feed conductors may be routed through the space between the ground planes to feed each of the radiators without interfering with their radiation pattern. The radiators are fed to produce circular polarization of opposite senses. This results in constructive field addition along the antenna's ground plane.

In a second embodiment, the entire isopatch antenna is fabricated as a single unit with only one feed port. This eliminates the need for separate microstrip elements to be mounted on separate ground planes by utilizing a completely internalized feed network comprised of a power divider and combiner. This feed network is sandwiched between a pair of dielectric substrate panels which in turn are bonded between the two ground planes of the microstrip patch radiators. A single RF input connector is mounted to the dielectric substrate material with a strip line transmission line connecting it to the internal feed network which then separates the incoming signal as appropriate to feed the two microstrip patch radiators in accordance with the teachings of the invention.

As is known in the art, the patch on each radiator may be fed by a pair of feed points, the feed points being 90° (physical) apart with the feed points of one radiator being 180° (physical) from the feed points of the other radiator. These feed points may then be fed by a simple feed circuit which splits the signal into separate components of half power at both 0° and 90° phase delay. Alternately, the physical location of the feed points and the electrical delays may be changed to suit the particular application, as is well known in the art.

In the particular application disclosed herein, the isopatch antenna is particularly suitable for use in a data link communicating between the aircraft and a ground instrumentation station. The antenna is placed within a radome on a captive carry pod on the aircraft and, as is expected, the aircraft and pod could take virtually any orientation to the linearly polarized ground receiver station and yet receive the data because of the omni-directional radiation pattern of the antenna. The wide radiation pattern and circular polarization excitation utilized provides almost complete coverage between the antenna pod and ground station, the only hole in coverage occurring as the ground station would appear in the ground plane of the antenna such that a cross polarization would result. In other words, with the omni-directional antenna of the present invention, the radiation pattern reduces to linear polarization in the common ground plane such that if the linearly polarized signal from the ground station became oriented parallel to the ground plane, the signal and radiation pattern would be perpendicular or cross polarized, thereby greatly diminishing the power of the received signal. However, the chance of this particular orientation occurring can be minimized by thoughtful placement of the antenna within the air-craft pod.

Although the principal advantages of the present invention have been described above, a more thorough understanding of the antenna and its operation may be attained by referring to the drawings and description of the preferred embodiment which follow.

BRIEF DESCRIPTION OF THE INVENTION

DETAILED DESCRIPTION OF THE PREFERRED EMBODIMENT

Figure 1:
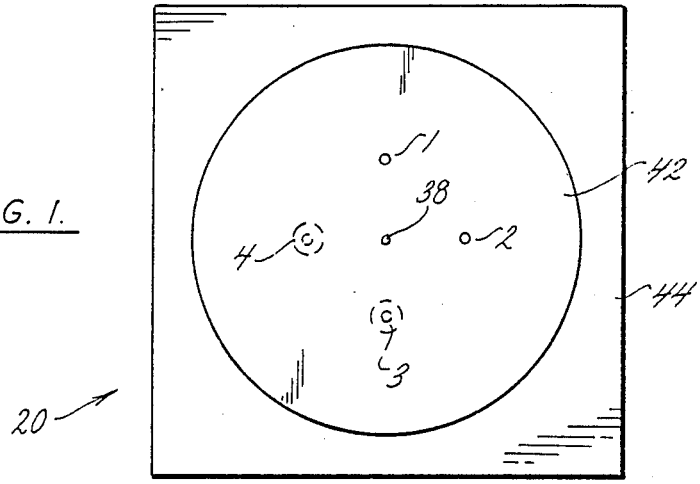
FIG. 1 is a top view of the microstrip patch antennas detailing the feed points for both the upper hemisphere element and the lower hemisphere element.
Figure 2:
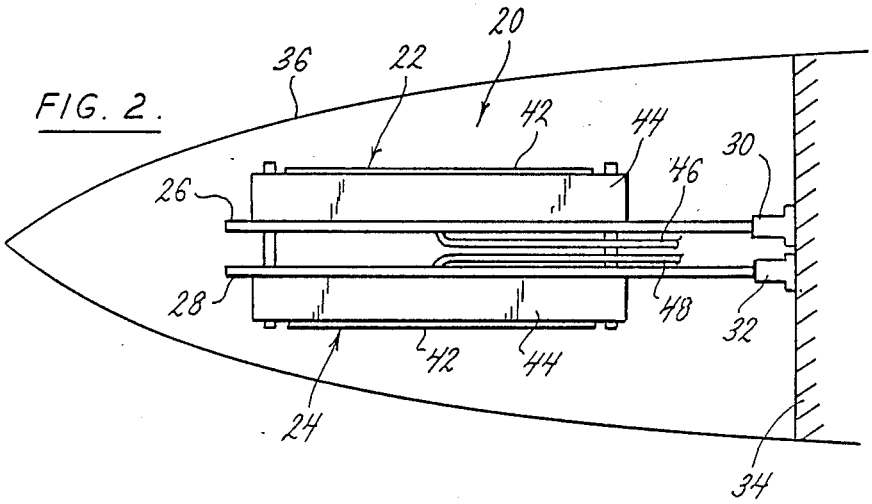
FIG. 2 is a side view of the isopatch configuration of microstrip patch antennas of the present invention detailing the ground plane mounting and feed cables.

As shown in FIGS. 1 and 2, the isopatch antenna 20 of the present invention is comprised of a pair of microstrip patch radiators 22, 24 which are each mounted to an associated ground plane 26, 28, respectively. Each of these ground planes 26, 28 may be a metal plate, and the two metal plates 26, 28 are oriented in close proximity but spaced apart therefrom with their edges mounted by edge mounting bars 30, 32 from a support 34. A radome 36, such as an instrumentation pod on an aircraft, may enclose the antenna 20, as known in the art.

As shown in greater detail in FIG. 1, each microstrip patch radiator 22, 24 has a pair of feed points. For upper hemisphere radiator 22, feed points labeled 1 and 2 in FIG. 1 are utilized. It is noted that these feed points 1, 2 are 90° (physical) apart with reference to a modal shorting pin 38. The lower hemisphere radiator 24 similarly has a pair of feed points 3, 4 as shown in FIG. 1, feed points 3, 4 being encircled in a dotted line to indicate that they are present only in the patch of the lower hemisphere radiator 24. It is noted that feed points 3, 4 are 180° (physical) from feed points 1, 2. When excited by the feed circuit 40 (FIG. 4), the upper hemisphere radiator 22 is excited in a left hand circular polarization pattern and the lower hemisphere radiator 24 is excited in a right hand circular polarization pattern. The importance of this will be explained in greater detail, infra.

As shown in FIGS. 1 and 2, each microstrip patch radiator 22, 24 may be conveniently made from PC board type construction, as is known in the art. A central radiating patch 42 of conductive material is separated by a layer of dielectric 44 from the ground planes 26, 28. Techniques are well known in the art to create microstrip patch radiators of the type disclosed and claimed herein. The feed lines 46, 48 for feeding the upper hemisphere radiator 22, and lower hemisphere radiator 24 extend through ground planes 26, 28 and are routed between the ground planes to avoid interfering with the radiation pattern for each radiator 22, 24. With this technique, minimum distortion of the radiation pattern is achieved.

Figure 3:
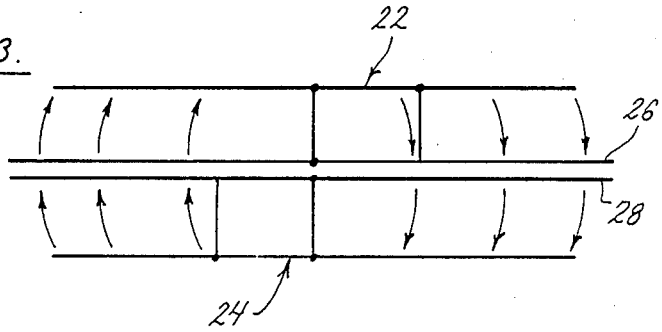
FIG. 3 is a schematic side view of the isopatch antenna of the present invention partially showing the fields inside and near the elements.

As shown in FIG. 3, the near fields of the upper hemisphere radiator 22 and the lower hemisphere radiator 24 are represented by the arrows. As is evident from viewing FIG. 3, these fields add constructively across the ground planes 26, 28 which has been found by the inventors to improve the overall reception of the antenna 20. Furthermore, this near field configuration achieves the omni-directional radiation pattern of the antenna.

Figure 4:
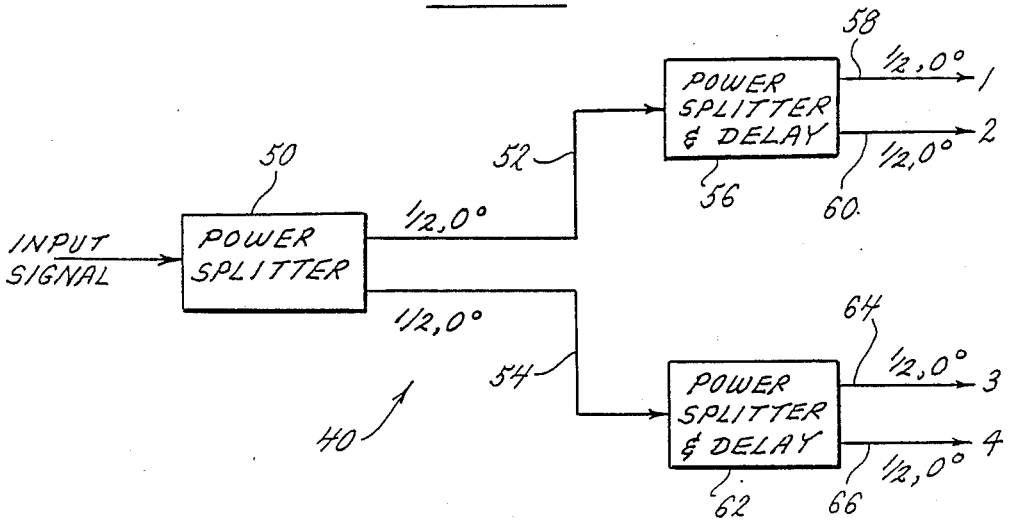
FIG. 4 is a schematic diagram of a feed for the microstrip patch antenna of the present invention.

An electrical feed 40 is shown in FIG. 4 for providing the necessary excitation to the feed points 1, 2, 3, 4 for creating the near field configuration as shown in FIG. 3. The input signal is first processed by a power splitter 50 to produce an output along conductor 52 at one-half the power level in phase with the input signal and a second output signal along conductor 54 at one-half the power level of the input signal and in phase therewith. The output along conductor 52 is then processed by a power splitter and delay 56 which produces a first output at one-half the power along conductor 58 and in phase with its input to feed feed point 1 and a second output along conductor 60 at one-half the power and 90° phase delayed to feed feed point 2. As is known in the art, this will result in a left hand circular polarization radiation pattern. Similarly, a second power splitter and delay circuit 62 will take the output from conductor 54 and generate an output along conductor 64 at one-half the power and in phase with the input to feed feed point 3 along with an output along conductor 66 at one-half the power and 90° phase delayed from the input to feed feed point 4. As is known in the art, this will excite the lower hemisphere radiator 24 to produce a right hand circular polarization pattern. As is well known in the art, both the location of feed points 1–4 and the feed circuit 40 may be modified to produce left hand and right hand circularly polarized radiation patterns for both the upper and lower hemisphere radiators 22, 24 which will satisfy the purposes of the antenna disclosed and claimed herein. It is merely necessary that the near fields add constructively across the ground planes to achieve the omni-directional radiation pattern of the antenna of the present invention.

Figure 5:
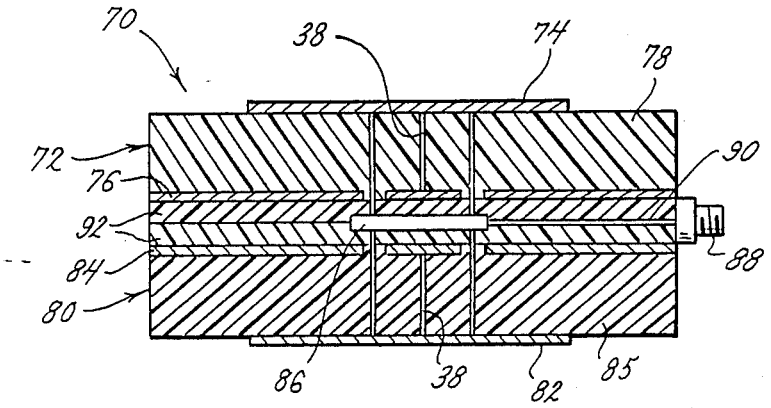
FIG. 5 is a cross-sectional view of the second embodiment.

As shown in FIG. 5, the second embodiment 70 of the antenna of the present invention includes a first microstrip patch radiator 72 comprised of a conductive patch 74 separated from a ground plane 76 by dielectric spacer material 78; and a second microstrip patch radiator 80 comprised of a conductive patch 82 separated from a ground plane 84 by a dielectric or printed circuit substrate 85. Between ground plane 76, 84 is mounted an internal feed network 86 which may be, for example, a four way combiner-divider Model No. 40600 as sold by Anaren Microwave Inc. which separates the incoming signal into four signals of equal magnitude with two pairs in quadrature phase relation. Each of these pairs of output is then used to feed either the first or second microstrip patch radiator 72, 80 such that they radiate opposite senses of circular polarization with the radiators 72, 80 being oriented in such a way that their fields add along the ground plane, much as in the first embodiment. An RF input connector 88 provides a means for input of the signal to be radiated through strip transmission line 90 to the internal feed network 86. Internal feed network 86 is mounted between a pair of dielectric substrate panels 92 which are then bonded between ground planes 76, 84 with a bonding film or other suitable means to create a single unit having high mechanical strength. The antenna of the second embodiment 70 may then be mounted to any particular surface by appropriate mechanical connection to the printed circuit substrate 78, 85 such as not to interfere with the electromagnetic operation of the antenna 70.

There are various changes and modifications which may be made to the invention as would be apparent to those skilled in the art. However, these changes or modifications are included in the teaching of the disclosure, and it is intended that the invention be limited only by the scope of the claims appended hereto.

We claim:

1. A substantially omni-directional radiating antenna comprised of a pair of antenna elements, each antenna element having a substantially hemispherical radiation pattern and an associated ground plane, said ground planes being substantially adjacent to their associated antenna element, means for feeding said antenna elements so that their radiation patterns add constructively at their ground planes and means for feeding each of said antenna elements for opposite senses of circular polarization such that the fields are in-phase across the ground planes.

2. The antenna of claim 1 wherein each of said antenna elements comprises a microstrip patch radiator.

3. The antenna of claim 2 wherein each of said associated ground planes comprises a conductive plate, each of said microstrip patch radiators being mounted to its associated conductive plate, and means to mount said conductive plates to a support to thereby mount and support the antenna.

4. The antenna of claim 3 wherein said conductive plates are substantially parallel and spaced apart from each other, and wherein said feed means includes conductor means, said conductor means extending between said plates.

5. The antenna of claim 4 wherein said feed means comprises a pair of feed points on each micro strip patch radiator, said feed points of each pair being 90° (physical) apart, and wherein said conductor means is terminated at each of said feed points.

6. The antenna of claim 5 wherein the feed points for one microstrip patch radiator are 180° (physical) apart from the feed points of the other microstrip patch radiator.

7. The antenna of claim 6 wherein the feed means further comprises means to feed one feed point of each pair with a first electrical signal and the second feed point of each pair with a second electrical signal, said first and second electrical signals being 90° (electrical) out of phase.

8. The antenna of further comprising a modal shorting pin extending between each microstrip patch radiator and its associated ground plane.

9. A substantially omni-directional radiating antenna comprising a pair of microstrip patch radiators, each of said radiators being mounted to an associated ground plane, said ground planes being oriented in close proximity but spaced apart from each other, means to excite each of said radiators so that their fields add constructively at their ground planes and means for feeding one of said radiators for right hand circular polarization and the other of said radiators for left hand circular polarization.

10. The antenna of claim 9 wherein each of said associated ground planes comprises a conductive plate, each of said microstrip patch radiators being mounted to its associated conductive plate, and means to mount said conductive plates to a support to thereby mount and support the antenna.

11. The antenna of claim 10 wherein said conductive plates are substantially parallel and spaced apart from each other, and wherein said feed means includes conductor means, said conductor means extending between said conductive plates.

12. A substantially omni-directional radiating antenna comprising a pair of radiating elements, each of said elements having an associated ground plane, and means to excite said elements in opposite senses of circular polarization.

13. The antenna of claim 12 wherein each of said ground planes are mounted in close proximity to each other, said elements thereby being mounted so that their near fields add constructively at their ground planes.

* * * * *